US005738408A

United States Patent [19]

Wu

[11] Patent Number: 5,738,408

[45] Date of Patent: Apr. 14, 1998

[54] STACKABLE FOLDING CHAIR

[76] Inventor: Henry Wu, 23441 Golden Springs Dr. #370, Diamond Bar, Calif. 91765

[21] Appl. No.: 706,346

[22] Filed: Aug. 30, 1996

[51] Int. Cl.[6] ..... A47C 3/04; A47C 4/10

[52] U.S. Cl. ..... 297/239; 297/58; 297/440.22

[58] Field of Search ..... 297/16, 58, 239, 297/440.2, 440.22, 219.1, 223; 108/91, 53.1

[56] References Cited

U.S. PATENT DOCUMENTS

| | | | |
|---|---|---|---|
| 2,390,878 | 12/1945 | Greitzer | 297/440.22 |
| 3,021,175 | 2/1962 | Norquist | 297/239 |
| 3,431,022 | 3/1969 | Poppe et al. | 297/440.22 |
| 3,695,687 | 10/1972 | Uyeda . | |
| 3,825,302 | 7/1974 | Kurtz . | |
| 4,619,207 | 10/1986 | Boyce et al. | 108/53.1 |
| 4,682,816 | 7/1987 | Massonnet | 297/239 |
| 5,064,247 | 11/1991 | Clark et al. . | |
| 5,096,259 | 3/1992 | Stanfield | 297/239 |
| 5,167,436 | 12/1992 | Wu . | |

FOREIGN PATENT DOCUMENTS

| | | | |
|---|---|---|---|
| 2098471 | 11/1982 | United Kingdom | 297/16.1 |

*Primary Examiner*—Peter M. Cuomo
*Assistant Examiner*—Anthony D. Barfield
*Attorney, Agent, or Firm*—Knobbe, Martens, Olson & Bear, LLP.

[57] ABSTRACT

A plurality of stackable folding chairs having two sets of legs pivotally attached to each other and a seat pivotally attached thereto. Indentations are formed in a first side of one of the two sets of legs and a protrusion is formed on a second side of the legs at approximately the same location. The chairs are configured to be folded so as to be substantially planar in configuration with the indentations and the protrusions exposed. The protrusions of a first chair can then be positioned within the indentations of a second chair so that the first and second chairs are positioned adjacent each other in a stacked configuration. The indentations preferably have an outer region that has a greater cross sectional area than the protrusions thereby facilitating positioning of the protrusion within the indentations and a second inner region having a cross sectional area that is configured so that the protrusion is flushly positioned within the inner region to thereby substantially prevent relative movement between the first and second chairs when the first and second chairs are in the stacked configuration.

15 Claims, 6 Drawing Sheets

STACKABLE FOLDING CHAIR

BACKGROUND OF THE INVENTION

This application claims the benefit of U.S. Provisional application Ser No. 60/003,152 filed Sep. 1, 1995.

1. Field of the Invention

The present invention generally concerns a folding chair and, in particular, concerns a stackable, easily assembled folding chair.

2. Description of the Related Art

Folding chairs are commonly used to provide readily available seating accommodations. Generally, folding chairs are used to provide temporary seating accommodations and, when not in use, are stored. For large scale use of folding chairs, such as use in schools, auditoriums and the like, the folding chairs are typically stored in a stacked configuration. One difficulty with most folding chairs is that they are difficult to stack in an organized fashion as the chairs have a tendency to slide relative to each other when stacked. To prevent this, the chairs are often stored in a specifically designed container or cart that has guide members to retain the chairs in an organized fashion.

There has been some effort made to design chairs that are stackable independent of a separate container or cart. In particular, U.S. Pat. No. 5,096,259 to Stanfield provides one example of stackable folding chairs. In this particular example, a brace is mounted on one of the back legs of the chair. The brace is configured to have a forward lug on one end and a rear stop on the other. When each of the chairs has the brace mounted in the same position on the back legs, the forward lug sits within the rear stop of the brace on the chair underneath thereby allowing the chairs to be stacked on top of each other. One difficulty with the brace disclosed in U.S. Pat. No. 5,096,259 is that this is an additional item that must be attached to the chair. In other words, the braces have to be attached to each of the chairs that is being manufactured. It can be appreciated that this significantly adds to the manufacturing costs associated with producing these chairs. A further difficulty with the attachment of U.S. Pat. No. 5,096,259 is that the person stacking the chairs must be able to specifically locate the chairs so that the lugs fall into the slots. This requires the person stacking the chairs to take special care to correctly orient the chairs to successfully engage the lugs with the slots which makes the stacking process more difficult and time consuming.

A further difficulty with many stacking chairs is that the cost of manufacturing the chairs is increased due to the complexity involved with assembling the chairs. In particular, most of the chairs have two sets of leg members that are hinged together to form an A-frame and there is a seat section which extends outward from one of the sets of leg members. Typically, this seat is positioned on a rod that extends between the two leg members. It can be appreciated that positioning the seat on the rod extending between the two leg members and then securely attaching the rod members to the two sets of leg members can require a considerable amount of work which can lead to increased manufacturing costs of these chairs.

Another difficulty associated with chairs of the prior art is that during the assembly of the chairs, the seat is often clipped into the seat frame using metal clips. This is an awkward manner of attaching the seats to the chairs and can also result in injury to the assembler. Moreover, the clips can become worn over time which can result in the seat not being adequately attached to the seat frame.

Hence, there is a need for a folding chair that is both stackable and easy to manufacture. To this end, there is a need for a chair that allows for stacking so as to minimize the space needed to store the chairs, but does not require any additional parts to be attached to the chair to achieve the stacking function. Further, there is a continuing need to design chairs where the final assembly of the chairs is simplified.

SUMMARY OF THE INVENTION

The aforementioned needs are satisfied by the stackable folding chair of the present invention which is comprised of a chair having two sets of leg members and a seat positioned therebetween wherein on a first side of a least one of the two sets of legs there is a protruding member integrally formed thereon and, on a second side, opposite the first side of the at least one leg, there is an opening configured to receive the protruding member. In the preferred embodiment, the legs of the chair are formed from injection molded plastic wherein the mold includes structures that will create the protrusion and the opening in the legs. Preferably, the opening and the protrusion are formed on the one or more legs at a position so that the protrusion can be positioned within an opening formed on a second chair in a desired stacked configuration.

Preferably, the protrusion has a first shape, which in the preferred embodiment is the shape of a star, wherein the shape has a first cross-sectional area. The opening also preferably also has the same shape. However, in the preferred embodiment, the opening has two levels. An upper level, adjacent to the outer surface of the leg, has the same shape as the protrusion but the cross-sectional area is larger. The inner region of the opening has the same shape as the protrusion but has a smaller area than the outer region. The inner region of the opening is preferably sized so that when the chairs are stacked on top of one another so that the protrusion extends into the opening, the protrusion fits flushly inside of the inner region of the opening.

It will be appreciated that since the outer region of the opening is somewhat larger than the protrusion, a person stacking the chairs can initially position the protrusion more readily in the outer region of the opening. Subsequently, the person stacking the chairs can then slightly maneuver the protrusion within the confines of the outer region of the opening until the protrusion falls into the inner region of the opening. This facilitates stacking of the chairs by allowing the stacker to generally position the protrusion in the opening and then, with a minimum of effort, more specifically position the protrusion in the opening. It can further be appreciated that since, in the preferred embodiment, the protrusions within the openings are formed through the injection molding process, the stacking function of the chairs can be achieved without the increased assembly costs associated with screwing or mounting a stacking member onto the leg of the chair.

In another aspect of the invention, the seat of the chair is constructed so as to facilitate easy assembly of the chair. In particular, the seat of the chair has two basic components, a frame, which is generally square in shape with a central opening, and a cushion. The frame has two holes through which are mounted pins that extend from the frame to matching holes in the legs of the chair to thereby secure the seat frame to the legs in a pivoting fashion. A mounting member is mounted on the bottom side of the cushion and the cushion is configured to be slightly larger than the opening in the seat frame. The mounting member is essentially comprised of a generally T-shaped member wherein the outer surface of the T-shaped member is configured to fit within two slots that are formed on the inner walls of the opening of the frame. The seat can then be assembled by positioning the cushion over the opening in the frame, maneuvering the outer surface of the T-shaped member into the slots in the seat frame and then sliding the seat cushion backwards along the seat frame until the cushion is seated on the frame. It will be appreciated that this allows for easy assembly of the seat cushion and frame.

These and other objects and features of the present invention will become more fully apparent from the following description with reference to the accompanying drawings.

DETAILED DESCRIPTION OF THE PREFERRED EMBODIMENT

Figure 1:
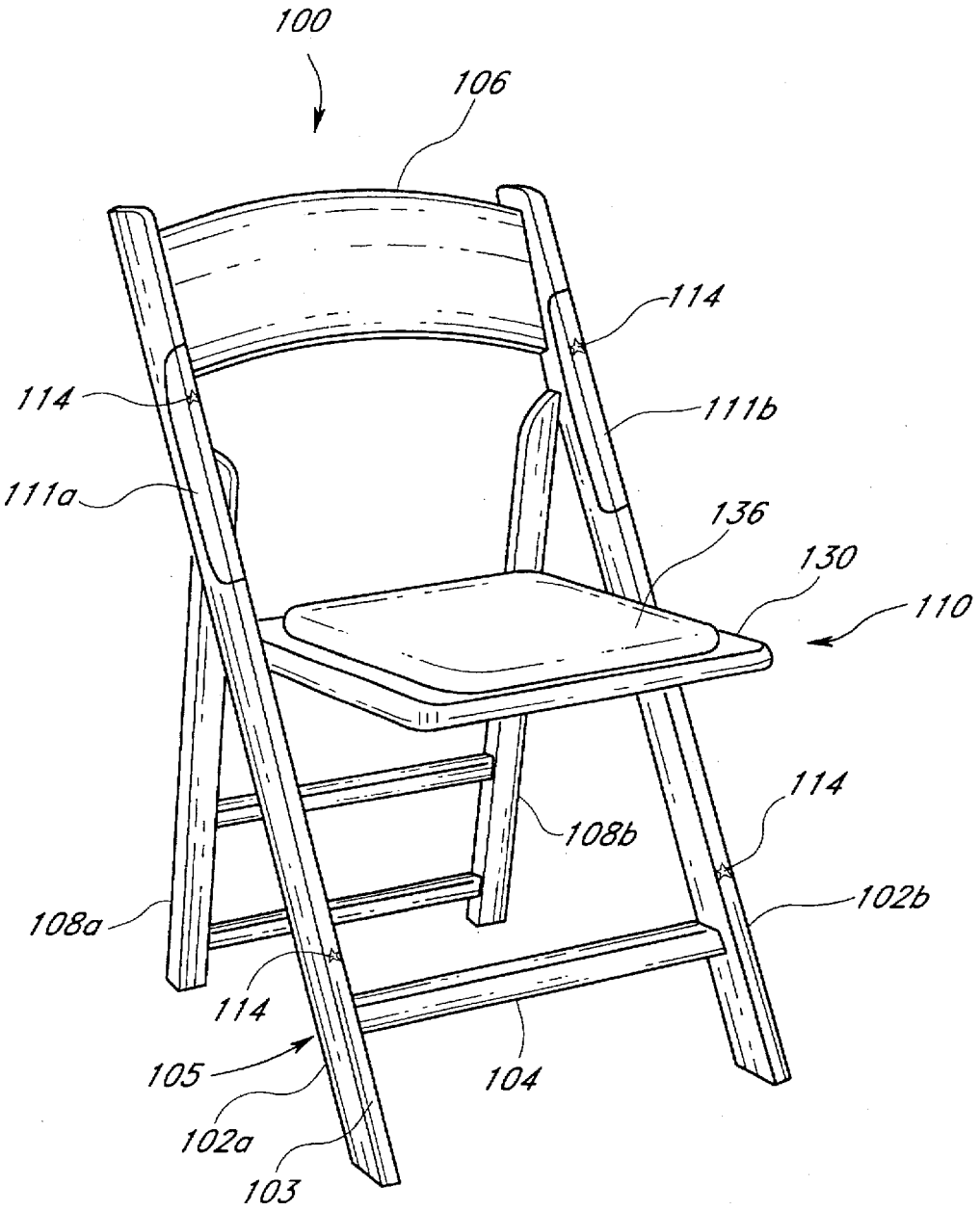
FIG. 1 is a perspective view of the preferred embodiment of the chair of the present invention illustrating that the chair has movable arm rests that are in an up position.

Reference will now be made to the drawings wherein like numerals refer to like parts throughout. FIG. 1 illustrates a chair 100 of the preferred embodiment. Preferably, the components of this chair are primarily formed using plastic injection molding techniques. The chair is essentially comprised of two from leg members 102*a*, 102*b* that are spaced apart but interconnected by a bottom brace member 104 and a backrest 106, and two back leg members 108*a*, 108*b* that are pivotally connected to the front leg members 102*a*, 102*b* so as to allow the chairs to be folded up in the manner shown in FIG. 3.

Figure 2:
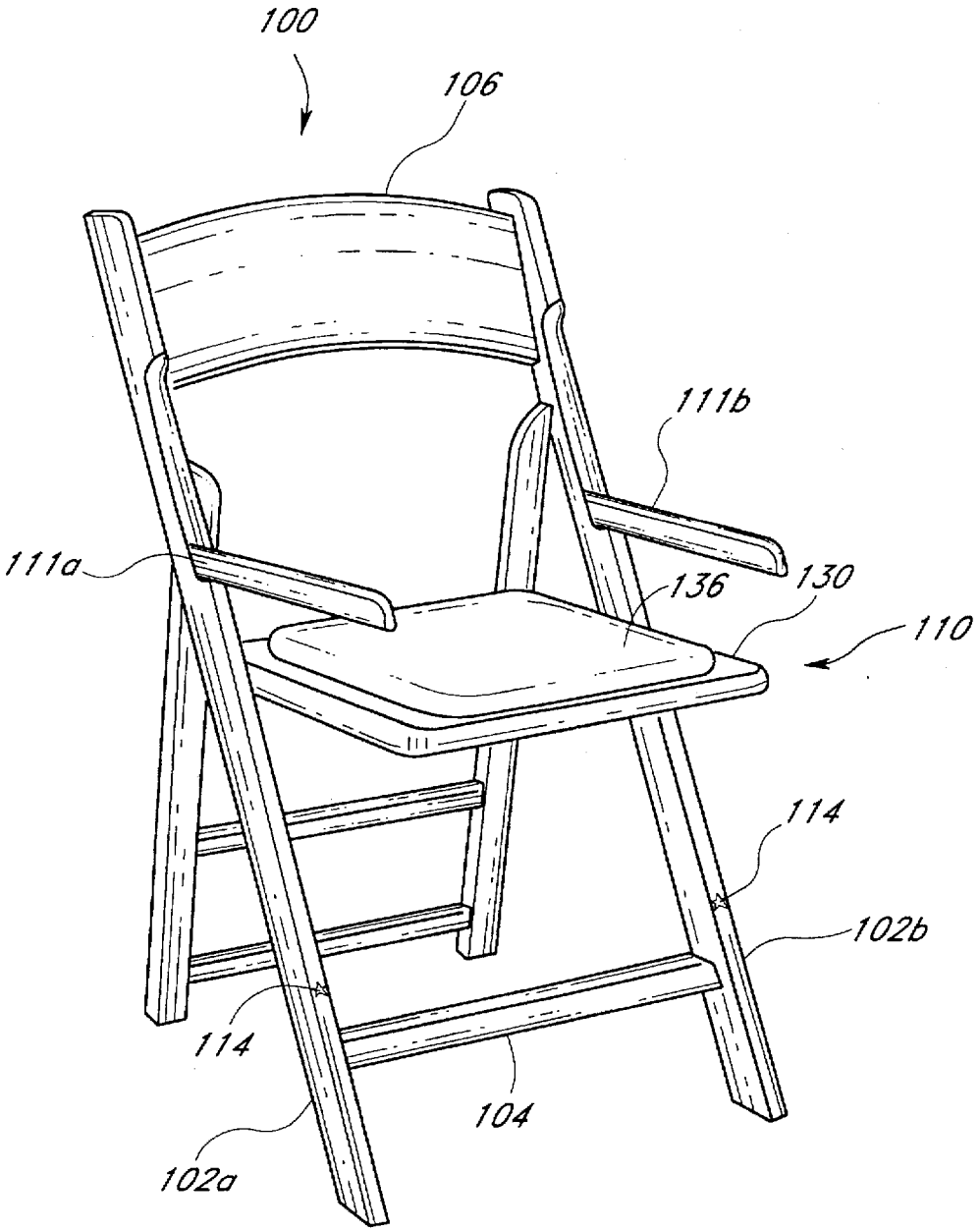
FIG. 2 is a perspective view of the chair shown in FIG. 1 with the armrest in a down position.

A seat portion 110 of the chair is pivotally connected to the two front leg members 102*a*, 102*b*. Further, as shown on FIG. 2, there are two armrests 111*a*, 111*b* that are pivotally connected to the two front legs so as to be movable between a stored position, wherein the armrests are flush with the front legs 102*a* and 102*b*, and a down position (FIG. 2) wherein the armrests extend outward from the front legs so as to allow a user to position his or her arms on the armrests.

As shown in FIG. 1, a front side 103 of each of the legs 102*a* and 102*b* has a protrusion 114 formed thereon. Similarly, an indentation 112 is formed on a backside 105 of the each of the legs 102*a* and 102*b* (See, FIGS. 4A and 4B) that is configured to receive the protrusion. In the embodiment shown in FIG. 1, the protrusions 114 are formed on the arm rests 111*a* and 111*b* and also on a lower section 107 of the legs 102*a* and 102*b*. The indentations are formed at substantially the same position on the backside 105 of the legs 102*a* and 102*b* as is illustrated in FIGS. 4A and 4B.

Figure 3:
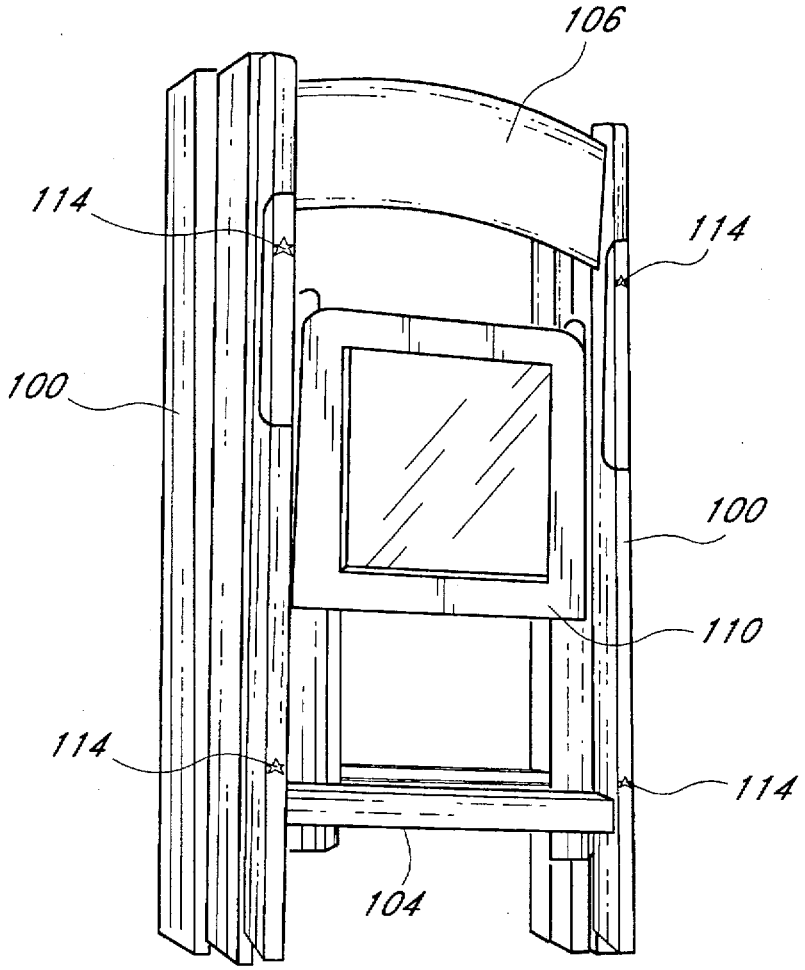
FIG. 3 is a perspective view of the chairs of FIG. 1 in a stacked position.

FIG. 3 illustrates the chairs in a stacked configuration wherein the seat portion 110 is folded up and the back legs 108*a*, 108*b* are pivoted forward so as to be adjacent the front legs 102*a*, 102*b*. In this configuration, the chair is essentially planer with the back legs 108*a* and 108*b* being positioned inward of the front legs 102*a* and 102*b*.

As shown in FIG. 3, when chairs are folded and positioned adjacent to one another, the protrusions 114 on the front side 103 of the chairs preferably fit within in the openings 112 on the back side 105 of the chair and retain the chairs in the stacked configuration shown in FIG. 3. Preferably, the location of the indentations 112 and the protrusions 114 on the legs 102*a* and 102*b* of each of the chairs 100 is selected so that the chairs can be stacked in an orderly fashion. In other words, the chairs 100 should stack with their top sides and bottom sides being perfectly aligned. It will be appreciated that if each of the chairs 100 is formed through plastic injection molding and the molds have the components necessary to form the protrusions 114 and indentations 112 in the exact same locations, that a plurality of chairs 100 that can be stacked in the fashion shown in FIG. 3 can be readily made.

Figure 4A:
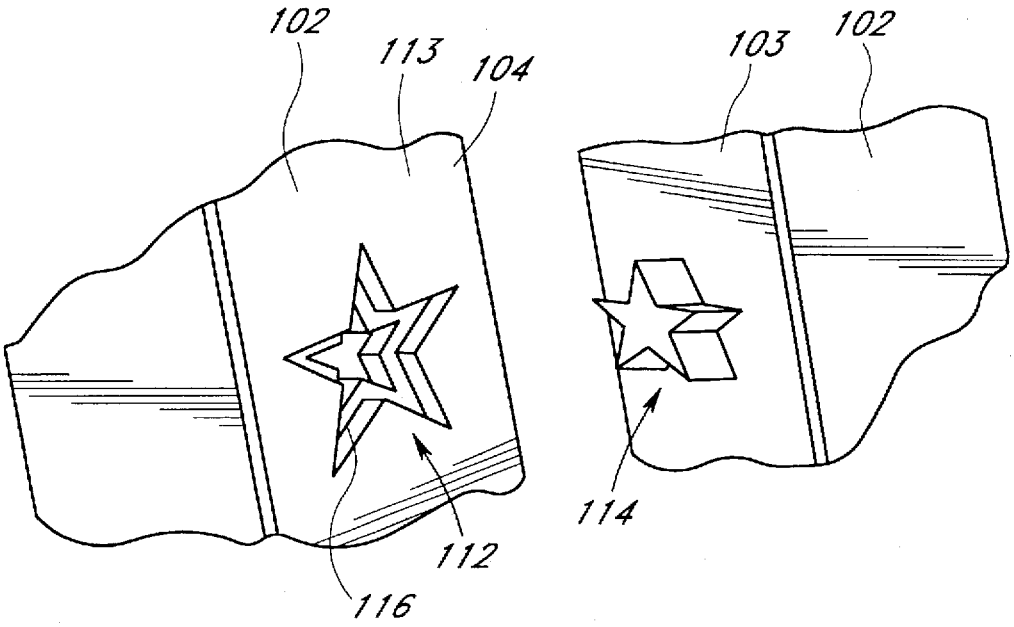
FIGS. 4A and 4B are schematic illustrations of a protrusion and an opening in the chairs illustrating a feature which permits easy stacking of the chairs.
Figure 4B:
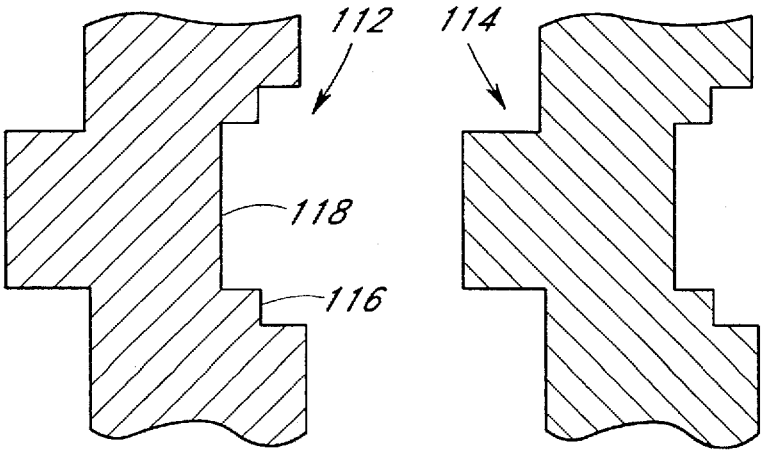

FIGS. 4A and 4B illustrate in greater detail the configuration of the protrusion 114 and the indentation 112. Specifically, FIG. 4A illustrates that the protrusion 114 has a first geometric shape that occupies a first surface area. The indentation 112 is preferably multi-leveled in that it has a first region 116 adjacent an outer surface 113 of the back leg 105 that has the same general geometric shape of the protrusion but occupies a larger surface area. Further, there is a second, inner, region 118 of the indentation 112 that is positioned inward of the first region 116 that has the same geometric configuration as the protrusion 114 and is dimensioned so that the protrusion 114 will sit flushly within the second region 118.

It will be appreciated that the protrusion 114 can first be generally located within the first region 116 of the indentation 112 by the person stacking the chairs. Since the first region 116 of the indentation 112 is larger than the protrusion 114, it will be easier for the person stacking the chairs to generally position the protrusion 114 of a first chair 100 within the first region 116 of the corresponding indentation 112 on a second chair 100. Subsequently, once each of the protrusions 114 of the first chair 100 is positioned within the first regions 116 in each of the indentations 112 on the back side of the second chair, the person stacking the chairs can then more easily position the protrusions 114 within the second region 118 to securely stack the first and second chairs together as the outer edges of the first region act as a boundary. FIG. 4B diagrammatically illustrates the profile of a protrusion 114 and of an indentation 112. As shown in FIG. 4B, the indentation 112 and the protrusion 114 are preferably positioned at opposite sides of the legs 102*a* and 102*b* at the exact same position on the legs. Further, the protrusion 114 extends outward from the front surface of the legs 102*a* and 102*b* a distance sufficient so that it will be seated within the lower region 118 of the indentation 112 when the chairs are correctly positioned together. It will be appreciated that when the protrusion 114 is positioned within the lower region 118, that the protrusion 118 fits flushly therein and the chairs are thereby prevented from moving with respect to each other.

Figure 5:
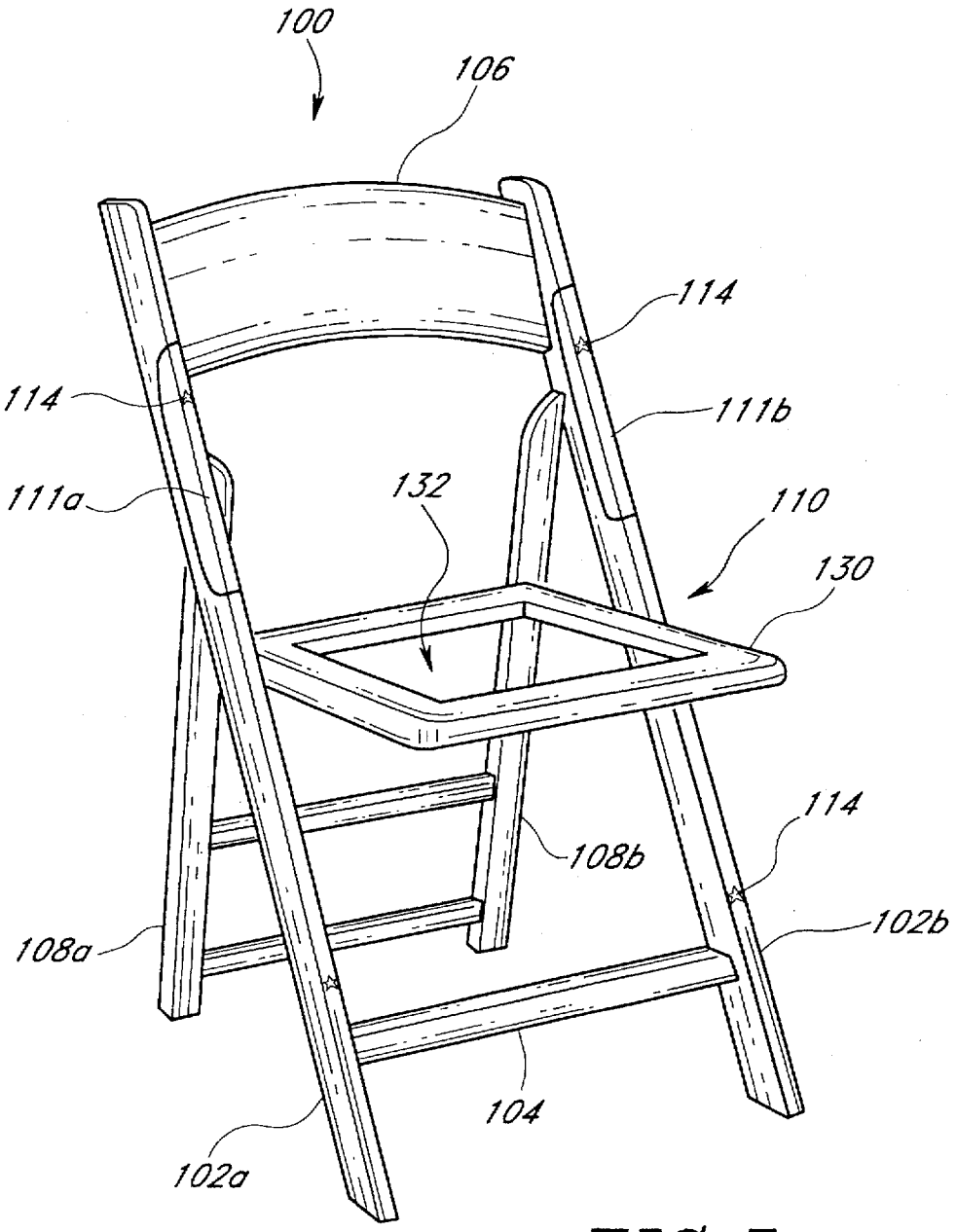
FIG. 5 is a perspective view of the chairs with the seat cushion removed.
Figure 6:
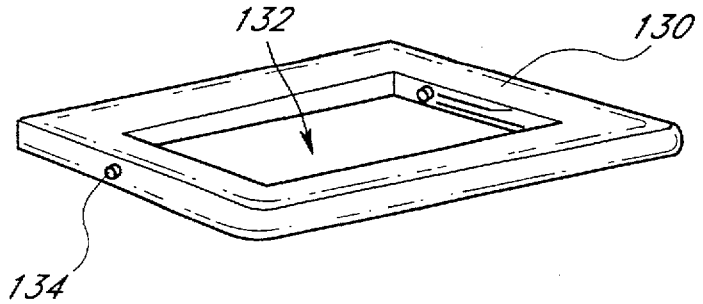
FIG. 6 is a perspective view of a frame section of the seat portion of the chair.

FIGS. 5 and 6 illustrate that the seat portion 110 of the chair 100 includes a frame 130. The frame 130 is generally square in shape and has a square-shaped opening 132 formed therein. Preferably, the frame 130 of the seat portion is attached to the legs via pivot members so that the seat portion 110 pivots in the manner shown in FIGS. 2 and 3. The pivot pins are attached to pin openings 134 (FIG. 6) formed on either side of the frame 130.

Figure 7:
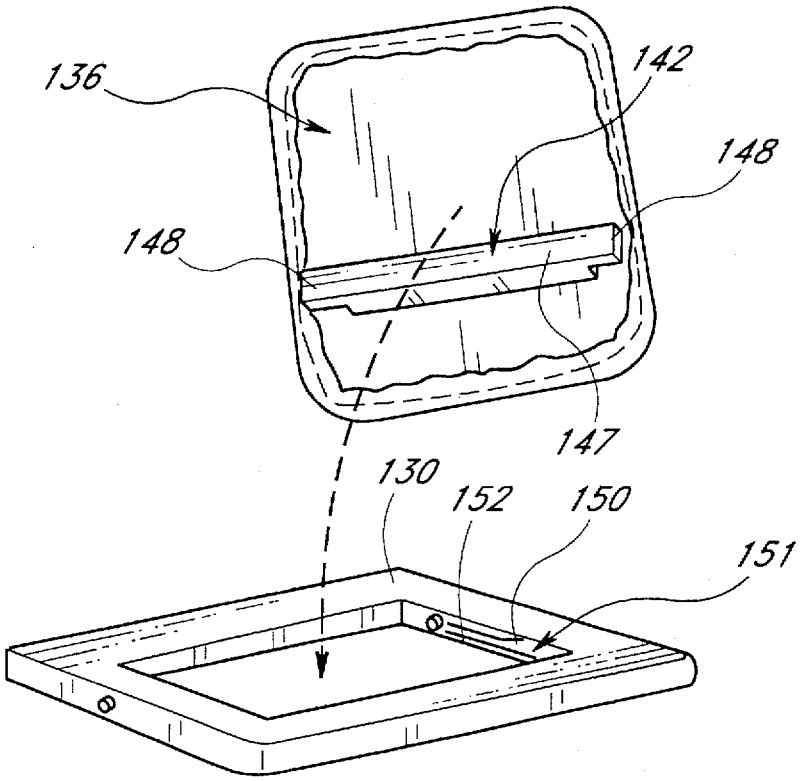
FIG. 7 is an exploded view of the seat portion of the chair.
Figure 8:
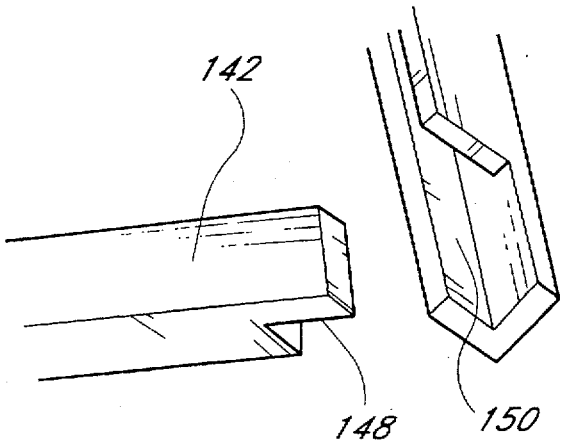
FIG. 8 is a detailed view of a mounting assembly formed on the bottom side of the cushion which is mated with the frame of the seat portion of the cushion to securely retain the cushion within the frame of the seat portion of the chair.

FIGS. 7 and 8 illustrate how the seat portion is assembled. Specifically, in FIG. 7, the cushion 136 is shown and, on the bottom side of the cushion, there is a mounting member 142 positioned thereon. The mounting member 142 extends generally entirely across the seat 136 and has a T-shaped cross-section. Specifically, the mounting member 142 extends laterally across the underside of the cushion 136 and has a raised section 147 that has two tabs 148 on the outer edges of the seat cushion 136. As shown in FIG. 7, the frame 130 of the seat portion 110 of the chair has grooves 150 (one shown) formed on either side of the frame 130. As shown in FIG. 8, the tabs 148 of the mounting member are configured to be positioned within the grooves 150 at a forward end 151 of the grooves 150 and then slid backwards until the cushion is resting on the frame 130 in the manner shown in FIGS. 1 and 2. It will be appreciated that the seat portion 110 of the chair of the preferred embodiment is easy to assemble in that the tabs 148 simply have to be positioned in the grooves 150 that have a wide opening at the forward end 151 to receive the tabs 148, and then slid backward until the tabs 148 are captured within the grooves 150. Preferably, the seat cushion 136, the mounting members 148 and the grooves 150 are configured so that the tabs are positioned at a rear end of the grooves 150 when the cushion 136 is positioned in the frame 130 in the manner shown in FIG. 1. Further, the grooves 150 can also be configured to have a retaining portion 152 sized to receive the tabs 148 to securely retain the tabs 148 in the retaining section 152 to securely retain the cushion 136 on the frame 130 of the seat portion of the chair.

It will be appreciated that assembly of the chair is simplified by the construction of the frame and seat cushion. Further, it will also be appreciated that the stacking capabilities of the chair are enhanced by the integrally formed protrusions and opening described in conjunction with FIGS. 1 through 4B.

Although the foregoing description of the preferred embodiments of the present invention have shown, described and pointed out the fundamental novel features of the invention, it will be understood that various omissions, substitutions and changes in the form of the detail of the apparatus as illustrated as well as the uses thereof, may be made by those skilled in the art without departing from the spirit of the present invention. Consequently, the scope of the invention should not be limited to the foregoing discussion, but should be defined by the appended claims.

What is claimed is:

1. A first stackable folding chair of a plurality of substantially identical stackable folding chairs, which comprises:

a first set of leg members that are connected to each other to maintain a first spaced distance from each other;

a second set of leg members that are connected to each other to maintain a second spaced distance from each other wherein said second set of leg members are pivotally connected to said first set of leg members so that said first and said second set of leg members can be positioned with a bottom end of each member spaced from each other to thereby retain said stackable chair in an upright position;

a seat coupled to said leg members that is configured to receive a person in a sitting position when said stackable chair is in said upright position wherein said first set of leg members, said second set of leg members and said seat can be oriented into a stackable configuration;

one or more protrusions integrally formed on a first face of at least one of said first set of leg members so as to extend outward from said first face of said at least one of said leg members said protrusions having a first shape and a first cross-sectional area; and one or more indentations integrally formed on a second face of at least one of said first set of leg members so as to be positioned opposite said one or more protrusions, wherein said one or more indentations include a first region positioned adjacent the second face of said leg member having a cross-sectioned area greater than said first cross-sectional area of said protrusion and having a second region positioned inward of said first region that has a cross-sectional area substantially equal to said first cross-sectional area of said protrusion wherein said one or more indentations are configured to receive said one or more protrusions on a second stackable chair of said plurality of substantially identical stackable chairs so that a user stacking said first and second chairs can initially position said protrusions in said first region of said indentations and then subsequently slightly move said first and said second chairs relative to each other to thereby position said protrusions on said second chair into said first region of said indentations in said first chair so that said second chair and said first chair can be stacked together.

2. The chair of claim 1, wherein said first set of leg members and said second set of leg members are pivotally connected so that both sets of leg members can be positioned adjacent each other in said stackable configuration and said seat is pivotally attached to said first set of leg members, so as to be pivotably into a position wherein said plane of said seat is adjacent said first and second sets of leg members when said first and second sets of leg members are positioned adjacent each other in said stackable configuration.

3. The chair of claim 2, wherein said one or more protrusions comprises four protrusions that are located on a front side of said first set of leg members substantially adjacent opposite ends of each of said second set of leg members and wherein said one or more indentations are located on a back side of said first set of leg members at substantially the same longitudinal position on said first set of said leg members as said protrusions.

4. The chair of claim 3, wherein said first geometric shape is a five pointed star shape and wherein said plurality of stacking chairs are each injected molded using substantially identical molds.

5. The chair of claim 1, wherein said seat comprises:

a seat frame that is substantially rectangular in configuration and defines a rectangular opening therein; and a seat cushion that is positionable within said seat frame so that said seat cushion is positioned in said substantially rectangular opening in said seat frame.

6. The chair of claim 5, wherein said seat cushion includes a mounting bracket positioned on a bottom side of said seat cushion wherein said mounting bracket defines two tabs located at outer ends of said mounting bracket.

7. The chair of claim 6, wherein said seat frame includes two grooves formed in an inner face of said seat frame positioned in said substantially rectangular opening wherein said two grooves are configured to, receive said two mounting tabs so that said mounting tabs can be positioned in said grooves and thereby retain said seat cushion on said seat frame.

8. The chair of claim 7, wherein said grooves extend in a first direction in said frame and have an opening of a first width at a first end that can receive said tabs, and said grooves narrow in a direction towards said second end so that said tabs can be slid into said grooves and retained therein.

9. A first stackable folding chair of a plurality of substantially identical stackable folding chairs, which comprises:

a first set of leg members that are connected to each other to maintain a first spaced distance from each other;

a second set of leg members that are connected to each other to maintain a second spaced distance form each other wherein said second set of leg members are pivotally connected to said first set of leg members so that said first and said second set of leg members can be positioned with a bottom end of each member spaced from each other to thereby retain said stackable chair in an upright position;

a seat frame that is coupled to one of said first or second sets of leg members that defines an opening having an inner face wherein the seat frame includes two grooves formed in said inner face of said seat frame wherein said two grooves extend in a first direction and have an opening of a first width at a first end and said grooves narrow in a direction towards said second end;

one or more protrusions formed on said first set of leg members;

a seat cushion that is positionable in the opening in the seat frame wherein said seat cushion includes a mounting bracket that defines two tabs located at outer ends of the mounting bracket wherein said two grooves in said seat frame are configured to receive said two mounting tabs so that said mounting tabs can be positioned in said grooves and thereby retain said seat cushion on said seat frame wherein said narrowing of said grooves retain said tabs in said grooves and thereby retain said seat cushion in said seat frame so that said seat cushion and said seat frame can receive a person in a sitting position when said stackable chair is in said upright position; and one or more indentations integrally formed on a second face of at least one of said leg members so as to be positioned opposite said one or more protrusions, wherein said one or more indentations are configured to receive said one or more protrusions on a second stackable chair of said plurality of substantially identical stackable chairs so that said second chair and said first chair can be stacked together.

10. The chair of claim 9, wherein said first set of leg members and said second set of said leg members are pivotally connected so that both sets of leg member can be positioned adjacent each other in a stackable configuration and said seat frame is pivotally attached to one of said first or second sets of leg members so as to be pivotable into a position wherein said plane of said seat frame is adjacent said sets of leg members when said leg members are positioned adjacent each other in said stackable configuration.

11. The chair of claim 10, wherein said one or more protrusions comprises four protrusions that are located on a front side of said first set of leg members substantially adjacent opposite ends of each of said second set of leg members and wherein said one or more indentations are located on a back side of said first set of leg members at substantially the same longitudinal position on first set of said leg members as said protrusions.

12. The chair of claim 11, wherein said one or more indentations have a first geometric shape and said one or more protrusions also have said first geometric shape so that said one or more protrusions of a first chair can be positioned within said one or more indentations of said second chair and fit flushly within at least a portion of said one or more indentations and thereby prevent relative movement between said first and said second stackable folding chairs.

13. The chair of claim 12, wherein the one or more indentations have a first region positioned adjacent said back surface of said front leg members and having said first geometric shape that has a cross sectional area substantially greater than a cross sectional area of said one or more protrusions and a second region positioned inward from said first region that has a cross sectional area substantially equal said cross sectional area of said one or more protrusions.

14. The chair of claim 13, wherein said protrusions and said indentations are configured so that a user stacking said first and said second chairs together can initially position said protrusions in said first region of said indentations and then subsequently slightly move said first and second chairs relative to each other to thereby position said protrusion on said second chair into said second region of said indentations in said first chair.

15. The chair of claim 14, wherein said first geometric shape is a five pointed star shape and wherein said plurality of stacking chairs are each injected molded using substantially identical molds.

* * * * *